US005423652A

United States Patent [19]

Thiede

[11] Patent Number: 5,423,652

[45] Date of Patent: Jun. 13, 1995

[54] GRAVE MARKER LIFTING AND SETTING DEVICE

[76] Inventor: Roger C. Thiede, 2060 Trillium Cir., Victoria, Minn. 55386

[21] Appl. No.: 266,547

[22] Filed: Jun. 28, 1994

[51] Int. Cl.[6] ..... B66C 23/00

[52] U.S. Cl. ..... 414/543; 280/43.24; 212/245

[58] Field of Search ..... 414/540, 541, 542, 543, 414/546; 212/223, 229, 230, 231, 232, 237, 242, 244, 245, 249, 254; 280/43.24, 43.14, 43.11, 43.17, 43.12, 43, 763.1

[56] References Cited

U.S. PATENT DOCUMENTS

| | | | |
|---|---|---|---|
| 81,317 | 8/1868 | Derrick . | |
| 203,974 | 5/1878 | Winters | 414/543 |
| 358,558 | 3/1887 | Lathrop | 414/543 |
| 934,334 | 9/1909 | Myers . | |
| 2,610,744 | 9/1952 | Dague | 212/245 X |
| 2,768,835 | 10/1956 | Hull | 280/43.24 |
| 2,792,945 | 5/1957 | Brenny | 212/254 X |
| 2,804,979 | 9/1957 | Lassiter . | |
| 2,892,555 | 6/1959 | Hooker | 414/543 |
| 2,974,809 | 3/1961 | Sellars et al. | 212/237 X |
| 3,024,925 | 3/1962 | Werner et al. | 414/543 |
| 3,869,149 | 3/1975 | Dixon | 280/763.1 X |
| 3,978,989 | 9/1976 | Avila, Jr. . | |
| 4,508,233 | 4/1985 | Helms | 414/543 X |
| 4,770,304 | 9/1988 | Woods . | |

OTHER PUBLICATIONS

Pacific Electric Cranes; Mar. 1969.

*Primary Examiner*—Frank E. Werner
*Assistant Examiner*—James Eller
*Attorney, Agent, or Firm*—James R. Cwayna

[57] ABSTRACT

A grave marker lifting and setting device for either initially placing grave markers or for resetting the same following displacement thereof, The unit includes a pivotal crane structure carried on a wheeled framework with the wheels being retractable such that the frame may be positioned directly on the ground for stability. A plurality of ground engaging stakes and screws are provided to insure that the unit is anchored to the ground and will not tip or move during lifting or placement or replacement of the marker,

10 Claims, 5 Drawing Sheets

GRAVE MARKER LIFTING AND SETTING DEVICE

RELATED APPLICATIONS

There are no applications by applicant currently on file in the United States Patent Office related to this application and the invention disclosed therein.

FEDERAL SPONSORSHIP

This invention is not made under any Federally sponsored research or development arrangement nor under any other independently sponsored research and development arrangement.

FIELD OF THE INVENTION

This invention relates generally to mobile lifting devices such as small cranes and the like and more specifically to a mobile crane device provided for the directed purpose of initial setting, lifting and resetting of grave markers wherein the frame of the device is readily placed on the ground for a first degree of stability and additional stability and ground anchoring is effected through various ground anchoring devices.

SHORT SUMMARY OF THE INVENTION

A mobile lifting device for the initial setting, lifting and resetting of grave markers particularly when the same have become displaced from their original set position.

The unit includes a wheeled, three sided frame with two of the sides being parallely spaced to span a grave site with the third side thereof connecting the rear ends of each said sides providing a base for a rotatable, positionable, vertical mast having an upper arm. A winch, sheave combination is arranged on the arm to provide lifting power to a cable arranged thereon, powered by the winch.

The wheels, located at the corners of the frame, are mounted on rotatable arms are which secure to the frame sides for mobility purposes and which are rotatable to raise the wheels which will lower the frame to the ground.

A ground screw anchoring bar is removably arranged across the extending, forward ends of the frame sides and the heads of ground screws are received thereon to assist in anchoring the frame to the ground. An additional number of ground engaging rods are provided to pass through apertures in the frame and at least of pair of vertical stability lines are provided to the mast with the ends thereof being ground engageable.

BACKGROUND AND OBJECTS OF THE INVENTION

Although applicant's device may be used for the initial placement of grave markers, it is more directed to the resetting of such markers after they have been moved due either to ground settling, vandalism, improper initial placement, base detioration or the like. To accomplish this, the marker is lifted and shifted from its resting spot and temporarily shifted so a new base, such as a concrete slab, can be poured or positioned with the marker thereafter returned to its proper position.

Applicant's device provides an easily moveable and thus non-ground marking, compact, crane or lifting device to be moved into position with respect to an upset marker with means to attach the marker thereto and lift and move the same while a proper base or the like is prepared for resetting the marker.

Applicant's device is compact to allow transport between cemeteries on a small utility trailer.

The device is provided with wheels which are shiftable from a first mobility position to a second, frame-on-ground position for stability of the unit.

Various means are provided to insure the stability of the device during lifting and shifting of the marker.

It is therefore an object of the applicant's invention to provide a grave marker lifting and setting device which is easily transportable over cemetery grounds without damaging or marking of the ground.

It is a further object of the applicant's invention to provide a grave marker lifting and setting device which provides a compact, mobile crane unit for the lifting and setting or resetting of grave markers, including a frame with spaced side rails to span a grave site.

It is a further object of the applicant's invention to provide a grave marker lifting, setting and resetting device which is ground stable to prevent movement, including "tip-over" during use.

These and other objects and advantages of the applicant's invention will become obvious with a consideration of the accompanying drawings and description.

SHORT DESCRIPTION OF THE DRAWINGS

DESCRIPTION OF A PREFERRED FORM OF THE INVENTION

Figure 1:
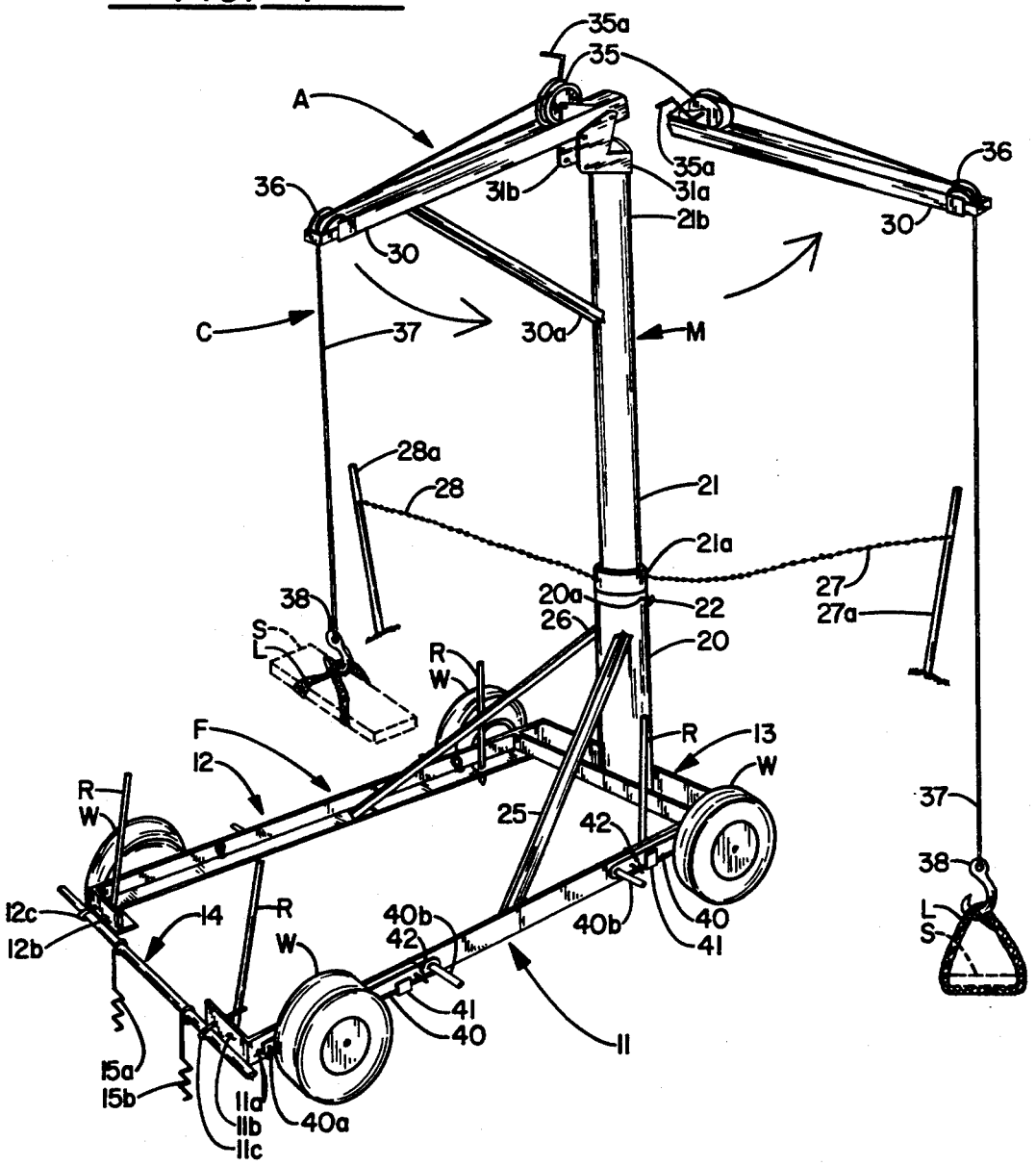
FIG. 1 is a perspective view of a grave marker lifting and setting device embodying the concepts of the invention and illustrating a lifted marker in dotted lines.
Figure 2:
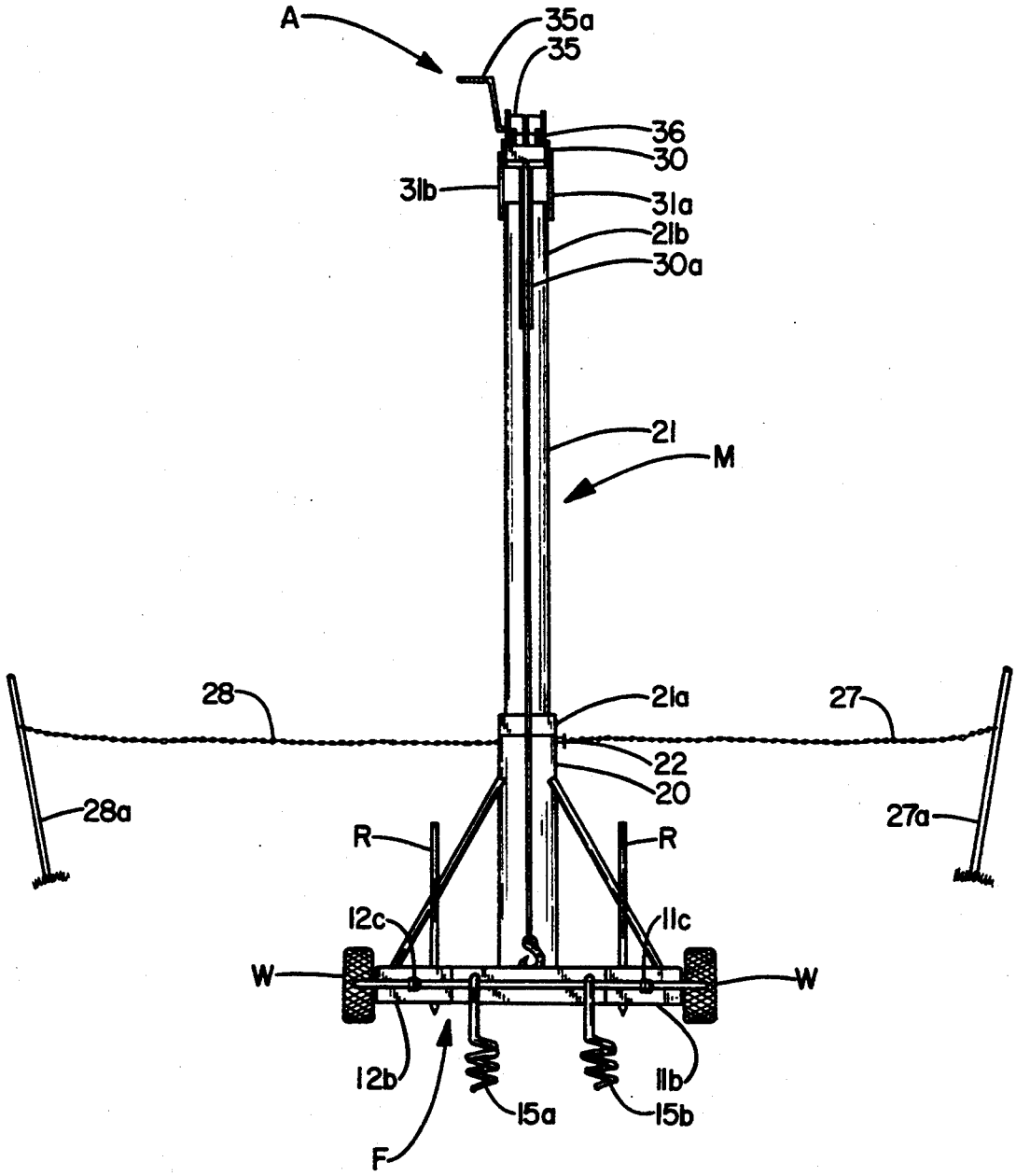
FIG. 2 is a front elevation of the device.
Figure 3:
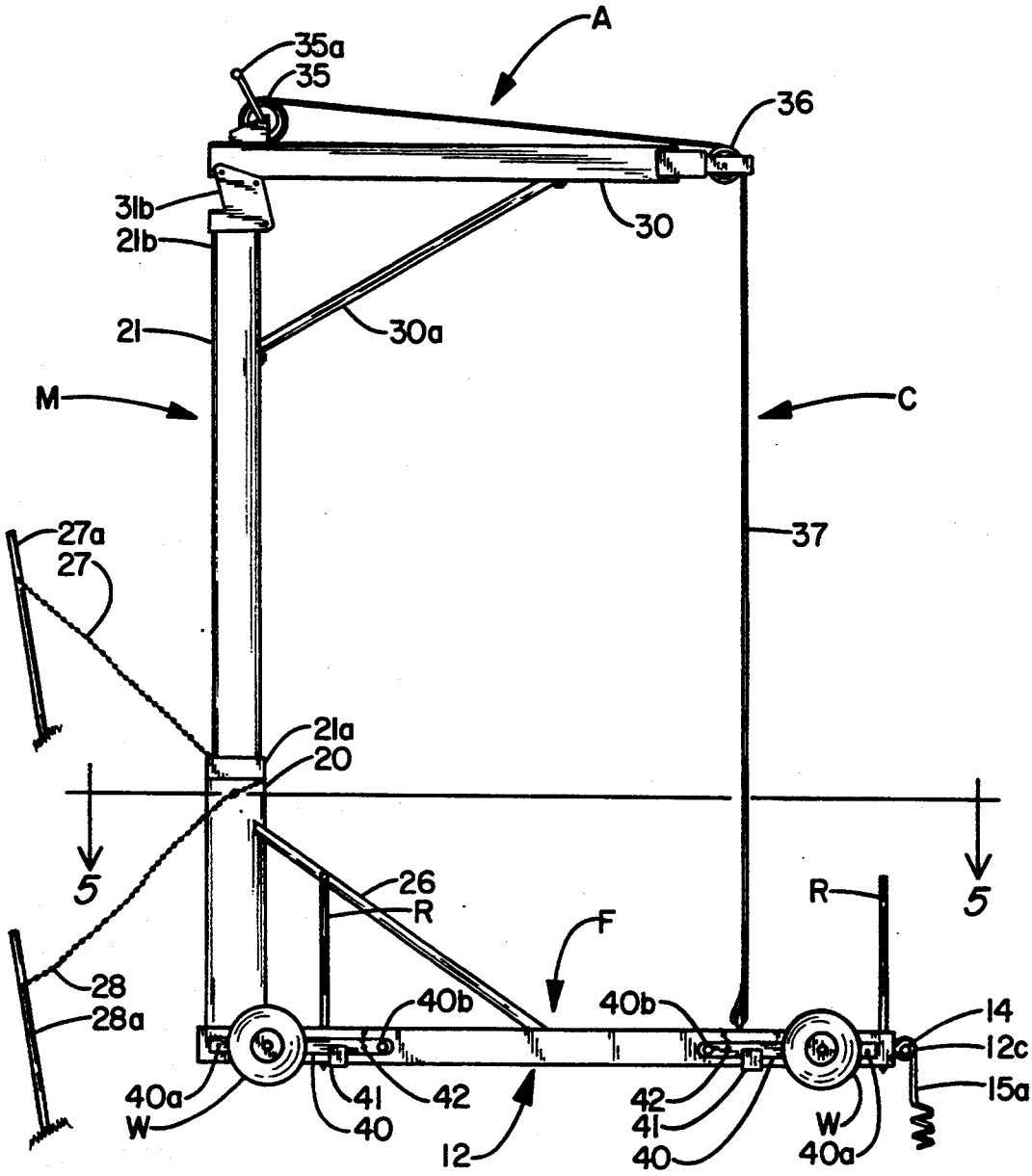
FIG. 3 is a side elevation of the device.
Figure 4:
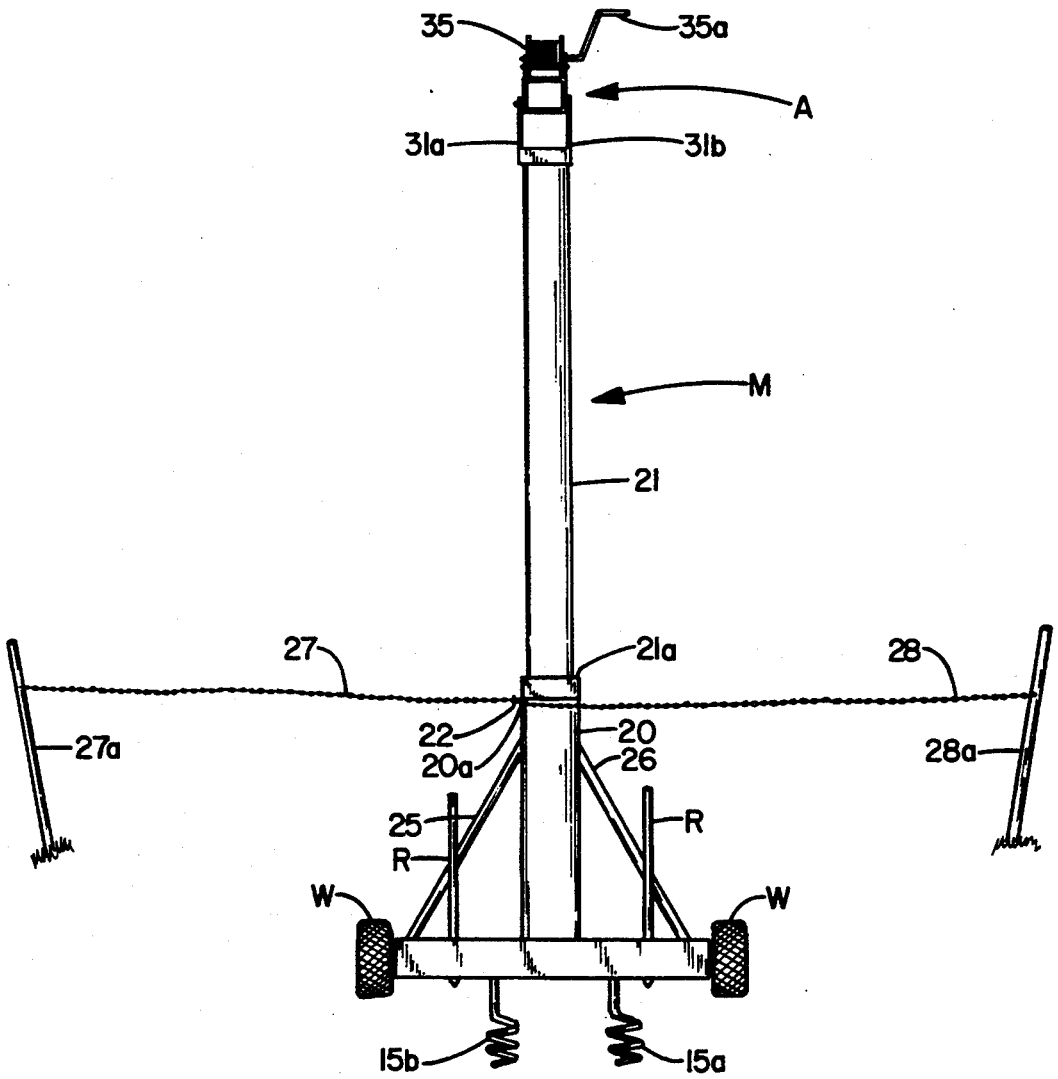
FIG. 4 is a rear elevation of the device.
Figure 5:
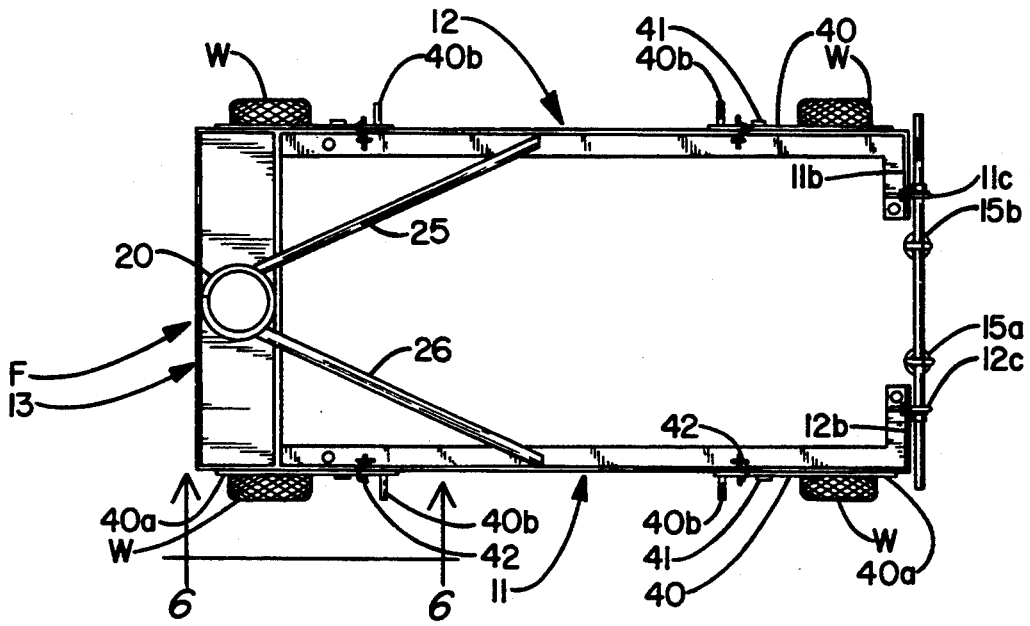
FIG. 5 is a top plan view having the upper mast portion and lifting arm removed and eliminating the vertical support elements; and, FIG. 6 is a partial section illustrating the wheel shifting arrangement to lower the frame to the ground.
Figure 6:
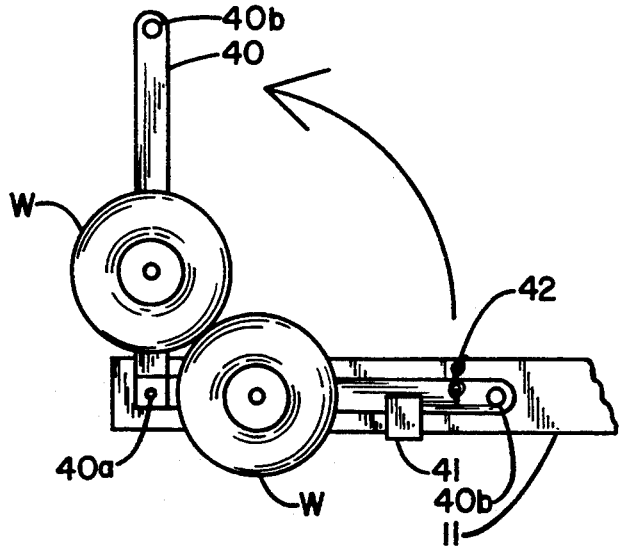

In accordance with the accompanying drawings, applicant's grave marker lifting and setting device is illustrated in perspective in FIG. 1 and is generally designated 10. The unit 10 basically includes a wheeled frame F, an upright mast M, a cantilever lift arm A, and a lifting cable assembly C. As illustrated in FIG. 1, the mast M is rotatable to shift a lifted marker S from its resting position to a temporary location to allow rework of the marker site.

The basic frame F includes a pair of longitudinally extending, transversely spaced side rails 11, 12 and a rear cross member 14. The frontal ends 11*a*, 12*a* of rails 11, 12 include inwardly directed ears 11*b*, 12*b* for removable placement of a cross rod 14 thereto through, for example, eyes 11*c*, 12*c*. The cross rod 14 provides a simple means for securing eye-headed ground screws 15*a*, 15*b* to the frame F after they have been inserted into the ground. Obviously, these ground screws 15*a*, 15*b* assist in locating and holding the frame either in wheel-elevated position or in frame-ground engaging position.

The side rails 11, 12 of frame F may be of any desired configuration such as I, C, H, L or rectangular shape. The applicant has chosen an angle or L-shape for such rails to provide a bottom plate portion through which ground engaging rods R may pass, again to add stability to the positioned frame F. Preferrably, such rods R are positioned at the rear and forward ends of the rails 11, 12, passing through apertures through the frame side rails 11, 12.

The rear cross member 13 provides a flat, mounting surface for a tubular, lower mast base 20 into which a rotatable upper mast portion 21 is positioned with such upper mast portion having a bearing ring 21*a* thereon. A pin 22 is provided to pass through an aperture 20*a* in mast base 20 and spaced, paired apertures (not visible) in the upper mast portion 21 will allow the upper mast portion 21 and carried arm A to be swung and positioned, for example, 90 degrees to the side, as shown in FIG. 1. Stability rods 25, 26 are provided between side frame rails 11, 12 and the lower mast portion 20.

In the form shown, vertical stability links such as chains 27, 28 and pins 27*a*, 28*a* are secured to the upper end of lower mast portion 20 and the pins 27*a*, 28*a* thereof are positioned in the ground a distance from the mast M. Obviously, these chains and pins provide for veritcal mast stability and the number of them provided is a matter of choice.

The lifting, cantilever arm A simply consists of a tubular or other sufficiently strong member 30 attached to the upper end 21*b* of upper mast portion 21 through brackets 31*a*, 31*b* or the like. A gusset support 30*a* may be provided between upper mast portion 21 and arm 30.

In the form shown, the lifting cable assembly C includes a ratchet or lockable winch 35 having an operating handle 35*a* at one end of arm 30 and a sheave 36 rotatably positioned on the outboard end of arm 30. The lifting cable is designated 37 and the hook for the end thereof is designated 38.

Various means may be provided to attach a marker S to the hook 38 and applicant illustrates a pair of slings L with one provided to encircle each end of the marker S.

Elevation and lowering of the frame with respect to the ground is obtained through Applicant's unique wheel mounting.

Each wheel W is rotatably mounted on a bar 40 which has one end 40*a* thereof pivotally connected to a frame rail with a handle 40*b* provided at the other end of such bar 40. An upwardly directed, U-bracket 41 receives bar 40 when the same and the carried wheel W is swung downwardly to raise the frame F for movement of the unit A captured or restrained pin 42 is attached to the frame F and apertures are provided through bar 40 and the frame rail to receive the same and thereby lock the bar 40 and carried wheel 40 in transport position. Removal of pin 42 will allow the bar 40 and attached wheel to be rotated upwardly, thus lowering the frame F to the ground.

Obviously, and as illustrated, the wheel units consisting of handled and rotatably mounted bars 40, wheels W, U-brackets 41 and pins 42 and necessary apertures are provided at the respect ends of the frame rails 11, 12.

As illustrated, the spacing between frame rails 11, 12 permit the same to straddle a grave site and provide stability to the unit. It should also be noted that the cross-bar 14, in effect provides a fourth side to the frame F. The aspect of the removeability of this rod 14 is to permit-the framed unit to be maneuvered past and around a set marker. The marker will effectively be located between the parameters of the "closed" four sided frame when lifted or reset.

It should also be obvious that the applicant has illustrated the various ground engaging pins, etc for extreme ground conditions or maker locations such as unlevel ground areas where the aspect of tip-over are great or the ground is unstable, for example, wet.

As suggested by the grave marker S illustrated, this unit is designed for use with relatively low profile markers.

It should be obvious that the applicant has provided a unique, mobile, stable, effective unit designed for the handling of grave markers.

What is claimed is:

1. A grave marker setting, lifting and resetting device including:

a. a lower frame providing at least.:
   1. a pair of transversely spaced, longitudinally extending side rails, each providing a front and a rear end;
   2. a crossarm extending between and connected to said rear ends of said side rails;

b. positionable wheel elements arranged on each of said side rails shiftable from a first position of elevating said lower frame above ground for movement to a second position of said lower frame resting upon the ground:

c. a vertically arranged mast on said crossarm having:
   1. a first, lower housing member;
   2. a second, upper member having a lower end rotatably received in said lower housing member and an upper end;

d. a cantilever arm secured to said upper end of said upper mast member extending outwardly therefrom including a winch, said winch including a cable;

e. a free end of said cable providing marker attachement means for lifting and manipulating a marker; and, f. first ground engaging, stabilizing rods arranged adjacent said front ends of said side rails of said frame whereby said forward ends of said frame are ground secured.

2. The grave marker setting, lifting and resetting device as set forth in claim 1 and said positionable wheel elements including a pair of said elements mounted respectively on the front and rear ends of each of said side rails.

3. The Crave marker setting, lifting and resetting device as set forth in claim 2 and each of said wheel elements including:

a. a crank arm having one end thereof pivotally attached to a side rail; and, b. a wheel pivotally mounted on one end said crank arm;

c. means for securing the other end of said crank arm to said side rail whereby said wheel elements are positioned to elevate said frame above ground in a first position, said means being releaseable from said side rail to shift said wheel elements to a second position permitting said frame to contact the ground.

4. The grave marker setting, lifting and resetting device as set forth in claim 3 and said means for securing the other end of said crank arm to said side rail including a bracket member to receive said crank arm and a pin member locking said crank arm to hold the crank arm within said bracket member.

5. The grave marker setting, lifting and resetting device as set forth in claim 1, and:

a. at least said side rails of said frame including vertical passages therethrough; and, b. ground engaging means arranged and constructed to be received through said passages to secure said frame to the ground.

6. The grave marker setting, lifting and resetting device as set forth in claim 1 and at least a pair of flexible mast attached, ground engaging members secured to at least said lower housing member of said mast whereby a vertical stabilizing force may be provided to said mast.

7. The grave marker setting, lifting and resetting device as set forth in claim 1 and means for positively positioning said upper member of said mast in selective arcuate locations on said lower housing member of said mast.

8. The grave marker setting, lifting and resetting device as set forth in claim 1 said winch being mounted on one end of said cantilever arm in generally vertical alignment with said mast; and including a cable receiving sheave mounted on the other end of said cantilever arm, the cable being controlled by said winch and passing over said sheave.

9. The grave marker setting, lifting and resetting device as set forth in claim 1 and said frame side rails being transversely spaced to span at least the width of a grave site.

10. A grave marker setting, lifting and resetting device including:

a. a lower frame providing at least:

1. a pair of transversely spaced longtudinally extending side rails, each providing a front and a rear end;
2. a crossarm extending between and connected to said rear ends of said side rails;

b. positionable wheel elements arranged on each of said side rails shiftable from a first position of elevating said lower frame above ground for movement to a second position of said lower frame resting upon the ground;

c. a vertically arranged mast on said crossarm having:

1. a first, lower housing member;
2. a second, upper member having a lower end rotatably received in said lower housing member and an upper end;

d. a cantilever arm secured to said upper end of said upper mast member extending outwardly therefrom including a winch, said winch including a cable;

e. a free end of said cable providing marker attachment means for lifting and manipulating a marker;

f. first ground engaging means arranged on extend between the forward ends of said side rails including:

1. a rod member arranged and constructed to extend between and be connected to said from ends of said side rails; and,
2. at least one ground screw element arranged for removeable attachment to said rod member whereby the front end of said frame is secured to the ground.

* * * * *